US011103040B2

(12) United States Patent
Haynes

(10) Patent No.: US 11,103,040 B2
(45) Date of Patent: Aug. 31, 2021

(54) HANDBAG WITH CUSTOMIZABLE ELECTRONIC DISPLAY

(71) Applicant: Lisa Haynes, Gambrills, MD (US)

(72) Inventor: Lisa Haynes, Gambrills, MD (US)

( * ) Notice: Subject to any disclaimer, the term of this patent is extended or adjusted under 35 U.S.C. 154(b) by 0 days.

(21) Appl. No.: 16/893,476

(22) Filed: Jun. 5, 2020

(65) Prior Publication Data

US 2021/0100330 A1 Apr. 8, 2021

Related U.S. Application Data

(60) Provisional application No. 62/911,533, filed on Oct. 7, 2019.

(51) Int. Cl.

| | |
|---|---|
| ***A45C 15/06*** | (2006.01) |
| ***A45C 13/00*** | (2006.01) |
| ***F21V 33/00*** | (2006.01) |
| *F21Y 115/10* | (2016.01) |
| *A45C 3/06* | (2006.01) |

(52) U.S. Cl.

CPC ..... *A45C 15/06* (2013.01); *A45C 13/001* (2013.01); *F21V 33/0004* (2013.01); *A45C 3/06* (2013.01); *F21Y 2115/10* (2016.08)

(58) Field of Classification Search

CPC ..... A45C 15/02; A45C 15/06

See application file for complete search history.

(56) References Cited

U.S. PATENT DOCUMENTS

| | | | | |
|---|---|---|---|---|
| 6,922,149 | B1 * | 7/2005 | Ford | A41D 1/005 340/539.1 |
| 7,751,285 | B1 * | 7/2010 | Cain | G04G 9/0017 368/82 |
| 8,847,760 | B1 * | 9/2014 | Watkins, Jr. | A45C 13/24 340/568.7 |
| D720,135 | S | 12/2014 | Leuty | |
| 9,144,282 | B2 | 9/2015 | Leuty | |
| 9,384,403 | B2 * | 7/2016 | Wimmer | G06F 3/04883 |
| 10,420,379 | B2 * | 9/2019 | Pond | G09F 27/00 |
| 2006/0061546 | A1 * | 3/2006 | Jong | G06F 1/1656 345/156 |
| 2012/0212940 | A1 | 8/2012 | Leuty | |
| 2016/0153645 | A1 | 6/2016 | Leuty | |
| 2016/0183654 | A1 | 6/2016 | Leuty | |

* cited by examiner

*Primary Examiner* — Sean P Gramling

(74) *Attorney, Agent, or Firm* — Fitch, Even, Tabin & Flannery LLP

(57) ABSTRACT

A handbag is provided having an integrated display system that includes one or more display screens within the chamber. The data displayed may be customized according to a user's preferences. It may also be provided to a user with pre-set information displayed. The display system may communicate with external devices that provide data to the display system for display on one or more of the display screens. The handbag may also include a lighting system that is integrated with or separate from the display system for illuminating the display system and/or the chamber of the handbag. A reflective surface may also be provided adjacent to the display screen, and can be used as a mirror and also as a protective surface such that the display screen data is visible through the reflective surface, while preventing damage to the display screen.

13 Claims, 3 Drawing Sheets

HANDBAG WITH CUSTOMIZABLE ELECTRONIC DISPLAY

FIELD OF THE DISCLOSURE

The present disclosure generally relates to a container for carrying items having an electronic display system. More particularly, the present disclosure relates to a handbag having an integrated electronic display system that is customizable and/or adapted and configured to display data and communicate wirelessly with other devices.

BACKGROUND OF THE DISCLOSURE

Containers and other portable carrying cases or handbags of various types are used to carry items. These items may include cosmetics, wallets, grooming instruments, phones, electronics, compact mirrors and other articles or personal effects. Occasionally, the chamber of the container may be too small, oddly shaped, or ill-suited to carry all items needed. For example, laptops or tablets, cell phones, mirrors, flashlights, and other items may add additional and undesirable weight in view of the desired shape and style of a handbag. However, it may be impossible or impractical to carry all of the desired items. For example, the dimensions of the container may be too small or inappropriately shaped to accommodate a phone or other electronic device.

BRIEF DESCRIPTION OF THE DISCLOSURE

In an embodiment, a handbag is provided comprising: a display system disposed within a chamber of the handbag. The display system includes at least one display screen for displaying data; a processor for providing data to the display screen; and a power source for providing power to the display screen and the processor. The display system is coupled to the chamber of the handbag such that the display screen is visible to a user. In an embodiment, the handbag further comprises a reflective surface provided on at least a portion of the chamber of the bag. In an embodiment, the at least one display screen is provided adjacent to the reflective surface such that the data displayed on the at least one display screen is visible through the reflective surface. In an embodiment, the reflective surface comprises an acrylic mirror.

In an embodiment, the handbag further comprises a lighting system that is electrically connected to the display system. In an embodiment, the lighting system is adapted and configured to illuminate the chamber when the handbag is in an open position. In an embodiment, the lighting system comprises one of electroluminescent lights and/or LEDs. In an embodiment, the lighting system shares a power source with the display system. In an embodiment, a processor module, the processor and/or related components is adapted and configured to send data selected by a user to the at least one display screen. In an embodiment, the processor is adapted and configured to receive data from an external device to display on the at least one display screen. In an embodiment, the external device is one of a computer, laptop, tablet, and mobile phone. In an embodiment, the display system is adapted and configured to automatically turn on when the chamber is in an open position. In an embodiment, the type of processor is a Raspberry Pi. In an embodiment, at least a portion of the handbag is made of a transparent material.

In an embodiment, the at least one display screen is disposed within the chamber of the handbag such that it is visible through the transparent material, when the handbag is in a closed position. In an embodiment, a first display screen for displaying a first data, and a second display screen for displaying a second data, wherein a first data and a second data are different. In an embodiment, the handbag is one of a purse, pouch, clutch, tote, briefcase, handbag, shoulder bag, and makeup bag. In an embodiment, a type of data is one of preselected data, user data, and manufacturing data. In an embodiment, the handbag further comprises a camera adapted and configured to save images to one of an integrated processor memory or a separate memory. In an embodiment, the separate memory is a memory card.

BRIEF DESCRIPTION OF THE DRAWINGS

The present disclosure is illustrated and described herein with reference to the various drawings, in which like reference numbers are used to denote like system components, as appropriate, and in which.

DETAILED DESCRIPTION OF THE DISCLOSURE

Figure 1:
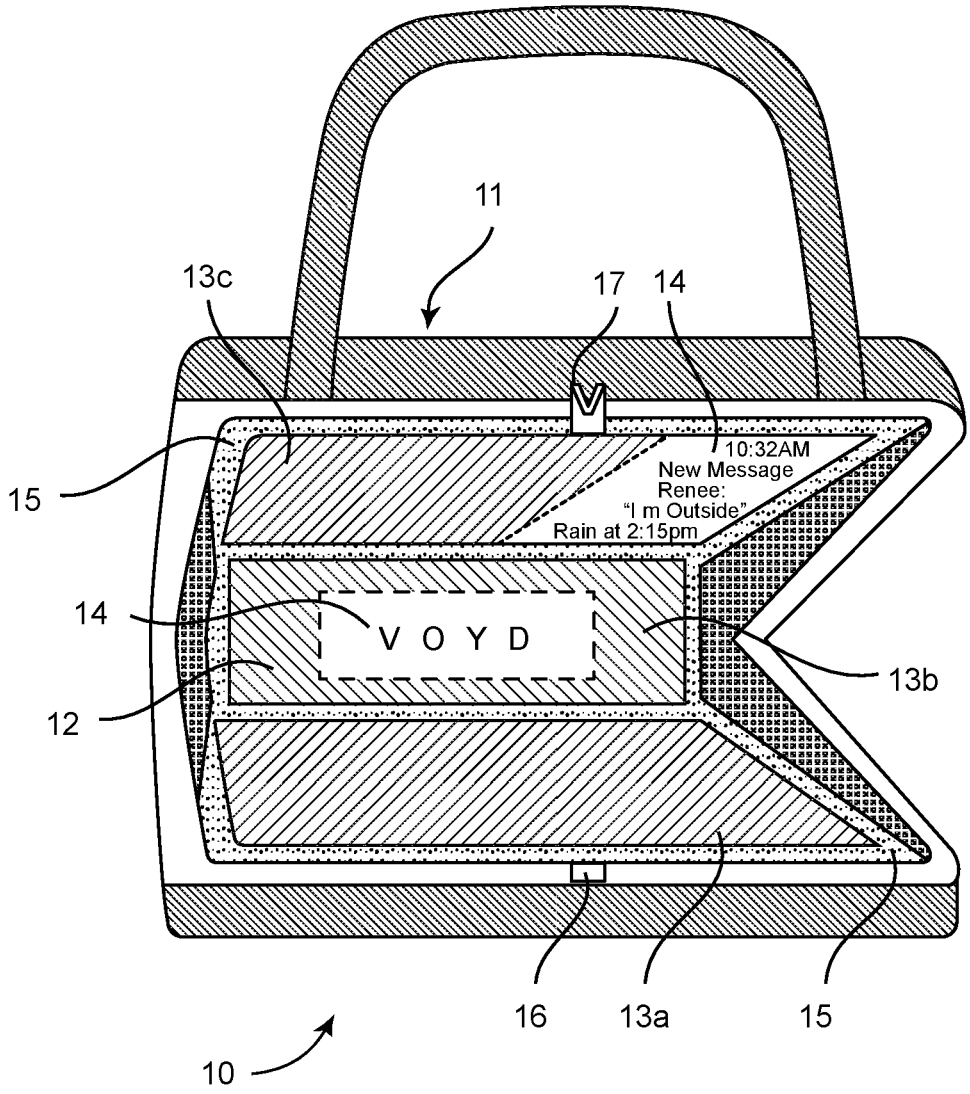
FIG. 1 is an illustration of a handbag in an open position having an electronic display system according to an embodiment of the present invention.

The present disclosure relates to systems and methods for providing an electronic display system within a bag or other container for carrying items. Embodiments of the bag herein may include a handbag, purse, clutch, tote, briefcase, shoulder bag, makeup/cosmetic bag or other container or carrying case for transporting items. Embodiments of a handbag are provided having an integrated display system that includes one or more display screens within the chamber. The information displayed may be customized and configured according to a user's preferences or may be provided to a user with pre-configured or standard information displayed. The display system may be adapted and configured to communicate with external devices that may transmit data to the processor of the display system of the handbag for display on one or more of the display screens. The handbag may also include a lighting system that is integrated with or separate from the display system for illuminating the display system and/or the chamber of the handbag. A reflective surface may also be provided adjacent to the display screen, and can be used as a mirror and also as a protective surface such that the display screen data is visible through the reflective surface, while preventing damage to the display screen. The embodiments of the handbag may also include a camera for displaying captured image data to the display screen. The image data from the camera may also be communicated to external devices via the processor.

The embodiments of the invention have several benefits and advantages including, but not limited to the following. The display system is integrated into a chamber of the bag, and thereby eliminates and/or reduces the volume, number and weight of additional items that are transported by the user. In some embodiments, the display system is in communication with other electronic devices such as computers, laptops, tablets, cell phones etc. Because the display system may be integrated with the handbag, such that it is coupled to the lining of the handbag, there is more room to carry other essential items within the chamber of the bag. This is particularly useful when the size of the handbag desired by the user is small. In addition, there is the added benefit of having access to information from mobile phones or tablets which are otherwise too heavy or too large to fit within the chamber of the bag. In addition, embodiments of the handbag with integrated display system may include multiple display screens. The information on one or more of the display screens may be configurable such that it provides various types of information, including identifying information of a user that may be helpful in enabling the safe return of the handbag and its contents should it be lost. The information displayed may be customizable by a remote device and selected so that a user's private information is not compromised. In an embodiment, the display screen of the display system may be disposed within the handbag in a manner such that it is visible only when the chamber of the handbag is opened by the user. In other embodiments, the display system may be integrated into the chamber and disposed through a transparent material, panel or portion of the internal or external surface of the handbag such that a user may view and/or interact with the display system when chamber of the bag is in a closed position. In an embodiment the display screen is visible to the user without having to open the chamber of the handbag.

FIG. 1 is an illustration of a handbag 10 in an open position according to an embodiment of the present invention. While a handbag 10 is illustrated in this embodiment, the invention and embodiments herein are not limited to the dimension, shape or style of the handbag 10 illustrated. The handbag 10 includes an external surface 11, and an internal chamber 12. In an embodiment, the chamber 12 refers to the inner portion of the bag where items are stored. The handbag 10 includes a display system having one or more display screens 14. (The display system will be described in further detail below.) In FIG. 1, two display screens 14 are provided. In an embodiment, multiple display screens 14 are provided of the same size. In an embodiment the display screens 14 are provided of varying sizes. In an embodiment, each of the display screens 14 have different information displayed thereon. In an embodiment, the display screens 14 have the same information displayed thereon. The information displayed on the display screen 14 may include, but is not limited to, one or more of the following types of data: brand name, logo or trademark of the handbag manufacturer, identifying information of the user, time, date, text messages, personal photos or other images, UPC or other bar codes or scanning codes, other preselected or predetermined user data. This has the advantage of the user being able to display information on one screen that is pre-determined or generic, for example, data received from, or located on the home screen of a user's mobile phone. On a second screen, more personal information selected by the user may simultaneously be displayed, such as daily quotes, news, weather, horoscope, scripture etc.

As noted above, the handbag 10 may be provided in a variety of shapes, sizes, and styles. Both the chamber 12 and the external surface 11 may be provided in a variety of materials. For example, the materials may include a soft fabric, leather, or alternatively a harder rigid material such as metal or plastic. In an embodiment, the external surface 11 surrounds a hard shell, case, or structure (not shown) that forms the shape of the handbag 10 and creates the corresponding shape of the chamber 12 where the items are stored. In an embodiment, all or a portion of the external surface 11 of the handbag 10 is made of a transparent material. The transparent material may be waterproof, or otherwise contain plastic, nylon or a suitable protective coating to prevent moisture or damage to the display system, items carried within the handbag 10, or wear and tear of the handbag 10 itself.

In an embodiment, the handbag 10 may include a separate lighting system 15 for illuminating the chamber 12. In an embodiment, the lighting system 15 is integrated with the display system. In an embodiment, one or more of the display screens 14 are adapted and configured to illuminate the chamber 12. In an embodiment, the handbag 10 may include at least one sensor 16 that is used to indicate whether the chamber 12 of the handbag 10 is in an open or closed position. The sensor 16 may be adapted and configured to be in communication with the lighting system 15 and/or the display system to control when the chamber 12 is illuminated. In an embodiment, the sensor 16 may be integrated with a closure mechanism 17 that is used to lock or secure the handbag 10 into an open or closed position.

In an embodiment, the handbag 10 may also include at least one mirror or reflective surface 13 provided within the chamber 12 as illustrated in FIG. 1. The reflective surface 13 may be integrated within the chamber 12 of the handbag via adhesive or other mechanical means. The reflective surface 13 may include one or more reflective panels 13*a-c* for use as a mirror for the user. In an embodiment, a reflective surface 13 having one or more reflective panels 13*a*-13*c* may be provided on the interior surface within the chamber 12 of the handbag 10. The reflective surface 13 may be provided in the form of one or more mirror panels. The reflective surface 13 may partially or almost completely cover the interior surface of the chamber 12.

In an embodiment, the display screen 14 is provided behind, adjacent to, and/or integrated with the reflective surface 13. A dielectric, glass, or acrylic mirror may also be used for one or more reflective panels 13*a*-13*c*, or alternatively all, or various portions of the reflective surface 13. In an embodiment, the reflective surfaces 13*a*-13*c* consist of one or more acrylic mirrors or mirror panels. The acrylic mirror material is stronger than glass and resembles a traditional glass mirror so as to be suitable for providing a vanity or personal mirror for the user. The acrylic material or other suitable material is also lightweight while also having a high surface strength which allows for items to move around without damage to the mirror or the items contained within the chamber 12. In an embodiment, the reflective surface 13 is positioned such that it is adjacent to the display screen 14, such that data displayed by the display screen 14 is visible through the reflective surface 13. In an embodiment, the reflective surface 13 may be integrated with the display screen 14.

The reflective surface 13 provided by the embodiments herein have many benefits and advantages. The reflective surface 13 is also made of a lightweight material, so that it does not add substantial weight to the handbag 10. The reflective surface 13 may also be capable of sustaining wear and tear from movement of items within the chamber 12 without shattering or damaging the display screen 14 itself or the items stored within the chamber 12 by the user. In addition, the reflective surface 13 within the chamber may serve as a vanity, thereby eliminating the need to carry a separate handheld or compact mirror, which could otherwise take up space within the chamber 12, and/or add unwanted weight to the handbag 10.

The handbag 10 may have one or more lighting system 15 for providing illumination of the reflective surface 13, and/or visibility of the items stored within the chamber 12. In an embodiment, there are a plurality of lighting elements positioned around a perimeter of the reflective surface 13 or surrounding one or more of the reflective panels 13*a*-13*c*, as shown in FIG. 1. However, other configurations are envisioned by the embodiments herein. In an embodiment, the lighting system 15 comprises electroluminescent light panels or strips. In an embodiment, the lighting system 15 includes LEDs or other suitable lighting devices capable of illuminating the internal chamber 12 of the housing of the handbag 10. The lighting elements 15 may be adapted and configured to automatically turn on when the user opens the handbag 10. In an embodiment, the sensor 16 (e.g., proximity sensor) is coupled to the closure mechanism 17 and utilized to detect whether the chamber 12 is in an open state or closed state (i.e., when the closure mechanism 17 has been disconnected, detached or unclasped). The lighting system 15 may be adapted and configured to turn on based on whether or not the closure mechanism 17 of the handbag 10 indicates that the handbag 10 is in an open or closed state based on information received from the proximity sensor 16 (or other suitable sensor) readout. Alternatively, the lighting system 15 may be provided with a user-initiated, manual turn on/turn off feature. The lighting system 15 may also be adapted and configured to be illuminate the handbag 10 so that the light is visible even when the handbag 10 is closed. One of the benefits and advantages of the lighting system 15 of the present invention is that a user may use the illuminated handbag 10 as a fashion statement, and/or as a safety mechanism when there are insufficient lighting conditions.

Figure 2:
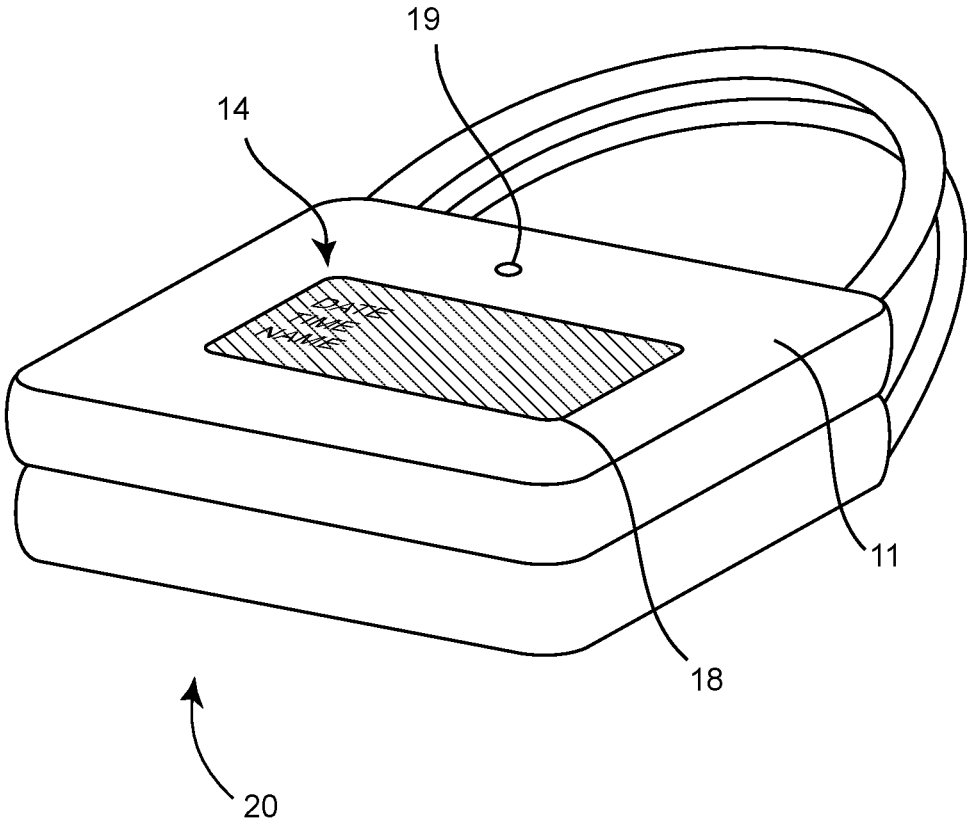
FIG. 2 is an illustration of a handbag in a closed position according to an embodiment of the present invention.

FIG. 2 illustrates a handbag 20 in a closed position. In this embodiment, the display screen 14 of the display system is disposed within the chamber 12 in an outward facing position such that the display screen 14 is visible to the user, externally, and the user is able to see and interact with the display even when the chamber 12 is in a closed position. The display screen 14 may be provided within a pocket, portion of the interior lining, or a transparent window 18 within the chamber 12. The transparent window 18 may be provided such that a user may interact with the display screen 14 of the display system by touching or pressing the transparent window 18 that is in contact with the display screen 14. In an embodiment, the transparent window 18 allows a user to touch and/or interact directly with the reflective surface 13 that is adjacent to the display screen 14. In this embodiment, a user can see his or her reflection from the reflective surface 13 or alternatively view the data from the display screen 14 while the handbag 20 is closed.

In an embodiment, a camera 19 is provided within the handbag 20 for taking pictures and providing them to the display system for display on the display screen 14. In an embodiment, the camera 19 is integrated with the display system, such that the camera 19 is a digital camera, and a lens of the camera 19 is provided on the same surface as the display screen 14. The display system may also be configured to transmit the images taken by the camera 19 to a user's external device(s).

Figure 3:
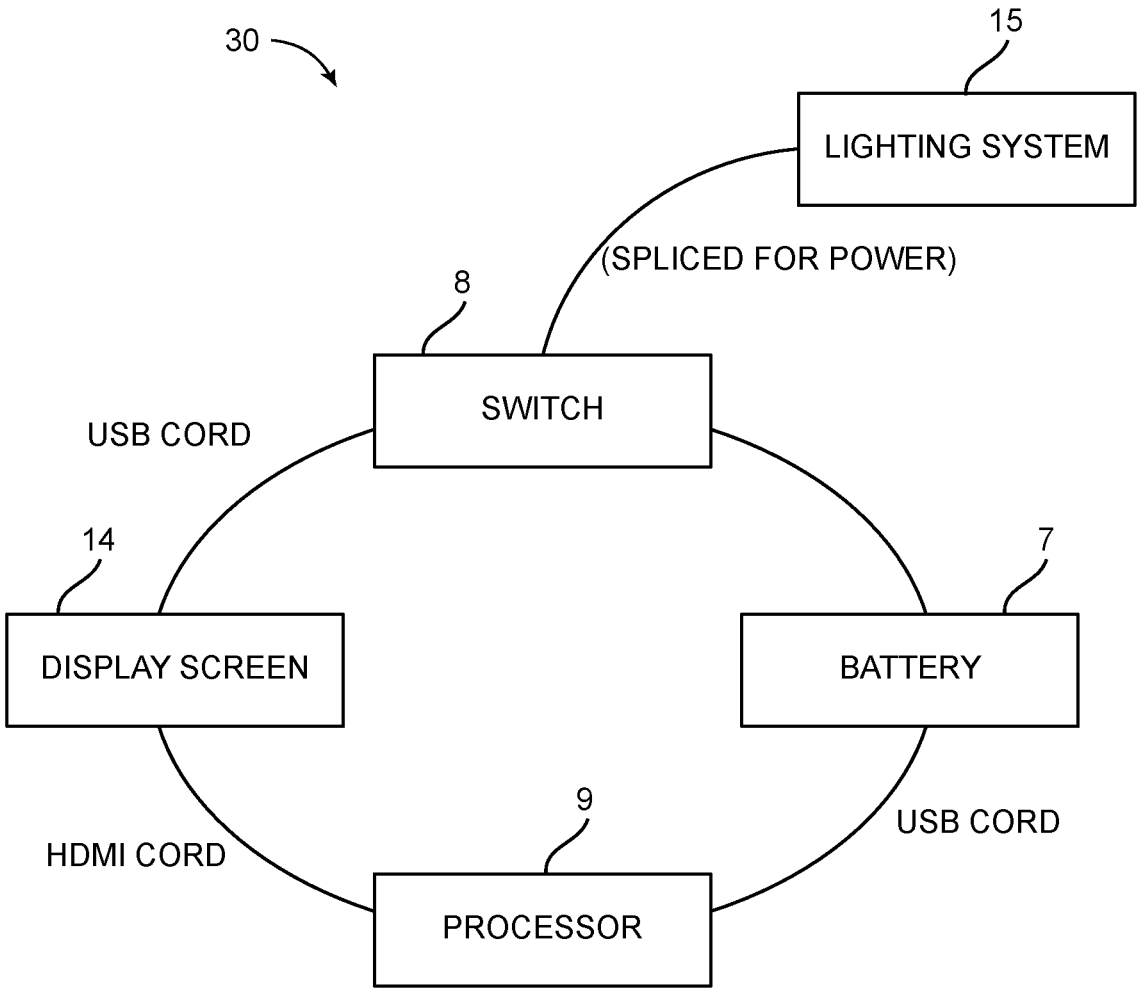
FIG. 3 is a block diagram of a display system connected to a lighting system according to an embodiment of the present invention.

FIG. 3 is a block diagram of components of an exemplary display system 30 connected to a lighting system 15 that is disposed within a handbag (not shown) according to an embodiment of the invention. The display system 30 includes one or more display screens 14 for displaying data, a processor 9, and a power source 7. The components of the display system 30 may be electrically connected together using suitable wires (e.g., USB, HDMI, other cables etc.) as provided in FIG. 3. As noted above, the displayed data can act as a generic pre-programmed source of data or it can be customized to reflect the personal preferences of the user (e.g., their name, photo/words of choice, daily quotes, news, weather, horoscope, daily scripture etc.). The processor 9 is used to process information from memory and provide data to the display screen 14. The memory (not shown) may be integrated into the processor or alternatively a detached/separate memory (e.g., memory card). The processor 9 may be a Raspberry Pi® or other suitable processor (e.g., a microprocessor).

In an embodiment, the lighting system 15 is connected to and/or may be part of the display system 30 and may be used to illuminate a handbag bag 10, 20. The placement of the light emitting elements (e.g., LEDs or electroluminescent lights) of the lighting system 15 may be disposed about a perimeter or opening of the chamber 12 or other enclosure of the handbag 10, 20. The power source 7 (e.g., a battery) may be shared by the lighting system 15 such that it powers all of the components of both the lighting system 15 and the display system 30, as provided in FIG. 3. However, in an embodiment, one or more components of the display system 30 and the lighting system 15 have independent power sources 7. In an embodiment, a switch 8 is provided. The switch 8 activates the lighting system 15 and display screen 14 from the power source 7. In an embodiment, when the handbag 10, 20 is in an open position, the switch 8 is pulled a part and triggers power from the power source to flow to the lighting system 15 and the display system 30. In an embodiment, with the exception of the display screen 14, the components of the display system 30 are integrated or coupled to (e.g., mechanical or other suitable attachment means such as sewing, grommets, glue or other adhesive) a metal or fabric lining within the chamber 12 of the handbag 10, 20 such that they are not visible to the user.

It will be appreciated that some embodiments of the display system or lighting system described herein may include one or more generic or specialized processors ("one or more processors") such as microprocessors; Central Processing Units (CPUs); Digital Signal Processors (DSPs): customized processors such as Network Processors (NPs) or Network Processing Units (NPUs), Graphics Processing Units (GPUs), or the like; Field Programmable Gate Arrays (FPGAs); and the like along with unique stored program instructions (including both software and firmware) for control thereof to implement, in conjunction with certain non-processor circuits, some, most, or all of the functions of the methods and/or systems described herein. Alternatively, some or all functions may be implemented by a state machine that has no stored program instructions, or in one or more Application Specific Integrated Circuits (ASICs), in which each function or some combinations of certain of the functions are implemented as custom logic or circuitry. Of course, a combination of the aforementioned approaches may be used. For some of the embodiments described herein, a corresponding device in hardware and optionally with software, firmware, and a combination thereof can be referred to as "circuitry configured or adapted to," "logic configured or adapted to," etc. perform a set of operations, steps, methods, processes, algorithms, functions, techniques, etc. on digital and/or analog signals as described herein for the various exemplary embodiments.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to information permanently stored on computer-readable storage mediums. Examples of such computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various exemplary embodiments.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated.

What is claimed is:

1. A handbag comprising:

a display system disposed within a chamber of the handbag comprising:

a reflective surface provided on at least a portion of the chamber;

at least one display screen for displaying data, the at least one display screen provided adjacent to the reflective surface such that the data displayed is visible through the reflective surface;

a processor for providing data to the display screen; and a power source for providing power to the display screen and the processor.

2. The handbag of claim 1, further comprising a lighting system that is electrically connected to the display system.

3. The handbag of claim 2, wherein the lighting system is adapted and configured to illuminate the chamber when the handbag is in an open position.

4. The handbag of claim 2, wherein the lighting system comprises one of electroluminescent lights and LEDs.

5. The handbag of claim 2, wherein the lighting system shares a power source with the display system.

6. The handbag of claim 1, wherein the processor is adapted and configured to send data selected by a user to the at least one display screen.

7. The handbag of claim 1, wherein the processor is adapted and configured to receive data from an external device to display on the at least one display screen.

8. The handbag of claim 7, wherein the external device is one of a computer, laptop, tablet, and mobile phone.

9. The handbag of claim 1, wherein the display system is adapted and configured to automatically turn on when the chamber is in an open position.

10. The handbag of claim 1, wherein a type of processor is a Raspberry Pi.

11. The handbag of claim 1, wherein the handbag is one of a purse, pouch, clutch, tote, briefcase, handbag, shoulder bag, and makeup bag.

12. The handbag of claim 1, wherein a type of data is one of preselected data, user data, and manufacturing data.

13. A handbag comprising:

a display system disposed within a chamber of the handbag comprising:

a reflective surface provided on at least a portion of the chamber;

at least one display screen for displaying data, the display screen being visible through the reflective surface;

a processor for providing data to the display screen; and a power source for providing power to the display screen and the processor, wherein the reflective surface comprises an acrylic mirror.

* * * * *